United States Patent [19]

Yamada

[11] Patent Number: 4,625,964

[45] Date of Patent: Dec. 2, 1986

[54] GOLF BALL

[75] Inventor: Mikio Yamada, Kobe, Japan

[73] Assignee: Sumitomo Rubber Industries, Ltd., Hyogo, Japan

[21] Appl. No.: 627,719

[22] Filed: Jul. 5, 1984

[30] Foreign Application Priority Data

Jul. 6, 1983 [JP] Japan ..... 58-123898

[51] Int. Cl.[4] ..... A63B 37/00

[52] U.S. Cl. ..... 273/62; 273/220; 273/230

[58] Field of Search ..... 273/228, 229, 218, 235 R, 273/220, 221, 219, 217, 62

[56] References Cited

U.S. PATENT DOCUMENTS

| | | | |
|---|---|---|---|
| 698,515 | 4/1902 | Kempshall | 273/229 |
| 712,411 | 10/1902 | Richards | 273/228 |
| 3,784,209 | 1/1974 | Berman | 273/235 R |
| 3,940,145 | 2/1976 | Gentiluomo | 273/218 |
| 4,065,537 | 12/1977 | Miller et al. | 273/218 |
| 4,431,193 | 2/1984 | Nesbitt | 273/218 X |
| 4,483,537 | 11/1984 | Hanada et al. | 273/218 X |

FOREIGN PATENT DOCUMENTS

| | | | |
|---|---|---|---|
| 1095615 | 12/1967 | United Kingdom | 273/220 |
| 2105595 | 3/1983 | United Kingdom | 273/218 |

*Primary Examiner*—George J. Marlo

*Attorney, Agent, or Firm*—Armstrong, Nikaido, Marmelstein & Kubovcik

[57] ABSTRACT

A solid golf ball consisting of a core, an intermediate layer and a cover, said core having a diameter of not more than 32 mm and a specific gravity of not less than 1.50 and being a composition comprising 100 parts by weight of a polybutadiene rubber, 10 to 50 parts by weight of zinc acrylate or methacrylate, 10 to 150 parts by weight of zinc oxide and 1 to 5 parts by weight of a cross-linking or curing agent; said intermediate layer having a thickness of 3.2 to 5.4 mm and being a composition comprising 100 parts by weight of a polybutadiene rubber, 10 to 50 parts by weight of zinc acrylate or methacrylate, 0 to 30 parts by weight of zinc oxide and 1 to 5 parts by weight of a cross-linking or curing agent, the specific gravity of said intermediate layer being lower than that of said core; and said cover having a thickness of 1 to 3 mm and a Shore D hardness of not more than 64.

4 Claims, 1 Drawing Figure

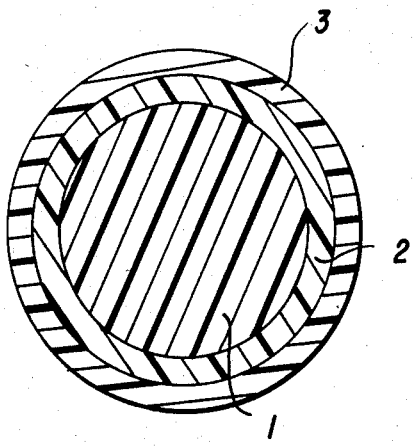
3
2
1

GOLF BALL

BACKGROUND OF THE INVENTION

The present invention relates to a solid golf ball.

Two-piece solid golf balls having two-layer construction which comprises a core and a cover are the most popular up to now. It is true that the two-piece balls have an advantage over wound balls in cut resistance, but it is hard to spin the balls, get hopped ballistic trajectory in a driver shot and stop the ball on the green in case of a short iron. It is considered that these faults result from the large moment of inertia, and the slipperiness on a club face because of the small area of contact of the ball with the club face owing to a hard cover, namely low deformation at impact.

It is a primary object of the present invention to eliminate such faults.

This and other objects of the present invention will become apparent from the description hereinafter.

SUMMARY OF THE INVENTION

In accordance with the present invention, there is provided a solid golf ball having a three-layer construction which comprises a core, an intermediate layer and a cover, said core having a diameter of not more than 32 mm and a specific gravity of not less than 1.50 and said cover having a Shore D hardness of not more than 64.

In the solid golf ball of the present invention, the specific gravity of the core is increased relative to conventional solid balls and the moment of inertia is reduced so that the ball might be given a backspin easily. Also, the hardness of the cover is maintained at a low value so that the balls might be deformed a little more to increase the contact area of the ball with a club face. The flight distance of the ball is extended and high controllability is obtained, because the increased contact area of the ball with a club face decreases the slip of the ball on the club face. Furthermore, the ball comes up to PGA standards in weight by the use of an intermediate layer having a low specific gravity between the core and the cover.

DETAILED DESCRIPTION

The core diameter of the golf ball in accordance with the present invention is determined to be at most 32 mm. Since the specific gravity of the core is made high in order to reduce the moment of inertia, it is unacceptable to increase the diameter beyond 32 mm because of the possibility that the ball will be disqualified for PGA standards in weight. It is necessary that the specific gravity of the core is at least 1.5 for making the spinning frequency as high as wound balls to gain a hopping trajectory and improving the controllability of the ball. Such a core can be easily obtained from a rubber composition which is prepared according to formulations of conventional core compositions for two piece solid golf ball, but with an increased amount of a weight controlling material such as zinc oxide. For instance, in a preferable embodiment of the present invention, the core composition contains 100 parts by weight of a polybutadiene rubber, 10 to 50 parts by weight of zinc acrylate or methacrylate, 10 to 150 parts by weight of zinc oxide and 1 to 5 parts by weight of a peroxide as a crosslinking or curing agent such as dicumyl peroxide.

The hardness of the cover of the golf ball in accordance with the present invention is determined to be at most 64 in terms of Shore D hardness. Since deformation of the ball in a golf shot is made somewhat large as compared with known solid golf balls so as to increase the contact area of the ball with a club face, the slip of the ball on the club face is prevented. Ionomer resins sold under the trademark "Surlyn 1652" and "Surlyn 1601" by the E. I. DuPont de Nemours Company, are particularly suitable as a material of the cover satisfying the above requirement. An inorganic filler such as titanium dioxide or zinc oxide may be suitably incorporated in a cover composition containing the ionomer resin for the purpose of coloring or the like. The cover composition may also contain additives such as antioxidants and stabilizers.

In the present invention, an intermediate layer is provided between the core and the cover in order to control the weight of the ball, because the specific gravity of the core is high. The specific gravity of the intermediate layer is made lower than that of the core. This is attained by decreasing the amount of a weight controlling material such as zinc oxide in comparison with that of the core, or no incorporation of zinc oxide. In other words, a rubber composition for the intermediate layer is prepared in accordance with known formulations of the core composition except for the amount of the weight controlling material. The specific gravity of the intermediate layer varies depending on the specific gravity of the core. Also, the thickness of the intermediate layer varies depending on the diameter of the core and the thickness of the cover which is usually from 1 to 3 mm. In general, the thickness of the intermediate layer ranges from 3.2 to 5.4 mm. In a preferable embodiment of the present invention, the intermediate layer composition contains 100 parts by weight of polybutadiene rubber, 10 to 50 parts by weight of zinc acrylate or methacrylate, 0 to 30 parts by weight of zinc oxide and 1 to 5 parts by weight of dicumyl peroxide.

Methods for preparing the solid golf ball of the present invention are not particularly limited, but known methods are adoptable. For instance, a core composition is molded in a mold by means of heat pressure molding. The obtained solid core is covered with a pair of hemispherical shells formed from an intermediate layer composition, and subjected to heat pressure molding in a mold. Two hemispherical shells formed from a cover composition are positioned around the intermediate layer and subjected to heat pressure molding at a high temperature for a short period of time, e.g. at 170° C. for 2 minutes. Alternatively, the cover composition is injection-molded directly around the intermediate layer to cover it. Buffing of the surfaces of the core and the intermediate layer is preferable, since the adhesion between the core and the intermediate layer and the adhesion between the intermediate layer and the cover are increased.

DESCRIPTION OF THE DRAWINGS

FIG. 1 illustrates a solid golf ball in accordance with a preferred embodiment of the present invention. The core 1 of the solid golf ball has a diameter of 32 mm and a specific gravity of not less than 1.50. The preferred composition of the core 1 is disclosed above. The intermediate layer 2 is preferably from 3.2 to 5.4 mm thick. The specific gravity of the intermediate layer is preferably lower than that of the core and a preferable composition for the intermediate layer 2 is disclosed above. The cover 3 of the present solid golf ball is preferably 1 to 3 mm thick and the Shore D hardness of the cover 3 is preferably at most 64.

The present invention is more specifically described and explained by means of the following Example and Comparative Examples in which all parts are by weight unless otherwise noted. It is to be understood that the present invention is not limited to the Example, and various changes and modifications may be made in the invention without departing from the spirit and scope thereof.

EXAMPLE 1 AND COMPARATIVE EXAMPLES 1 TO 5

Five kinds of golf balls having a diameter of 41.2 mm were prepared from the compositions shown in Table 1. A sixth ball having a wound core was covered with the cover composition shown in Table 1.

The three-layer balls of Example 1 and Comparative Examples 1, 3 and 4 and the two-layer ball of Comparative Example 2 were prepared as follows: A core composition was molded in a mold at 160° under pressure for 25 minutes. The obtained solid core was covered with two half shells formed previously from an intermediate layer composition, and was molded in a mold at 165° C. under pressure for 30 minutes. Two half shells were formed from a cover composition. They were positioned around the solid core or the intermediate layer on the core, and molded in a mold at about 170° C. under pressure for 2 minutes. Prior to the covering of the core with the intermediate layer followed by the heat pessure molding, the surface of the core was buffed, and also, prior to the covering with the cover, the surface of the intermediate layer or the core was buffed.

The wound ball of Comparative Example 5 was prepared by covering a wound core with the cover composition in the same manner as above except that the molding was conducted at 150° C.

The characteristics of the obtained golf balls were measured.

The results are shown in Table 1.

TABLE 1

| | Ex. 1 | Com. Ex. 1 | Com. Ex. 2 | Com. Ex. 3 | Com. Ex. 4 | Com. Ex. 5 |
|---|---|---|---|---|---|---|
| Core composition (part) | | | | | | |
| Polybutadiene rubber | 100 | 100 | 100 | 100 | 100 | — |
| Zinc methacrylate | 30 | 30 | 30 | 30 | 30 | — |
| Zinc oxide | 124 | 75 | 58 | 124 | 110 | — |
| Dicumyl peroxide | 1.5 | 1.5 | 1.5 | 1.5 | 1.5 | — |
| Diameter of core (mm) | 28.0 | 28.0 | 37.3 | 28.0 | 33.0 | — |
| Weight of core (g) | 18.9 | 15.8 | 35.4 | 18.9 | 29.7 | — |
| Specific gravity of core | 1.64 | 1.35 | 1.30 | 1.64 | 1.58 | — |
| Intermediate layer composition | | | | | | |
| Polybutadiene rubber | 100 | 100 | — | 100 | 100 | — |
| Zinc methacrylate | 30 | 30 | — | 30 | 30 | — |
| Zinc oxide | 2 | 35 | — | 2 | 2 | — |
| Dicumyl peroxide | 1.5 | 1.5 | — | 1.5 | 1.5 | — |
| Outside diameter of intermediate layer (mm) | 37.4 | 37.8 | — | 37.4 | 37.4 | — |
| Total weight of intermediate layer and core (g) | 35.8 | 35.3 | — | 35.8 | 38.9 | — |
| Cover composition (part) | | | | | | |
| Surlyn 1652* | 100 | 100 | 100 | — | 100 | — |
| Surlyn 1706* | — | — | — | 100 | — | — |
| Surlyn 1601* | — | — | — | — | — | 100 |
| Titanium dioxide | 2 | 2 | 2 | 2 | 2 | 2 |
| Hardness of cover (Shore D) | 64 | 64 | 64 | 67 | 64 | 61 |
| Properties of ball | | | | | | |
| Hardness of ball (PGA) | 98 | 98 | 100 | 99 | 99 | 95 |
| Weight of ball (g) | 45.3 | 45.0 | 45.1 | 45.3 | 48.4 | 45.1 |
| Moment of inertia | 67.00 | 68.31 | 70.71 | 67.08 | — | 65.69 |
| Spinning frequency (rpm) | 3540 | 3190 | 3010 | 3220 | — | 3650 |
| Trajectory | good hopped | straight low | straight low | straight low | — — | good hopped |
| Carry (m) | 192 | 185 | 186 | 185 | — | 193 |

*Trademark of an ionomer resin sold by E. I. Dupond de Nemours Co.

Notes:

1. The striking test was made by striking a ball with a driver of 43 inches at a head speed of 45.1±0.2 m/sec. employing a swing machine (Swing Robot made by True Temper Co., Ltd.). The spinning frequency was counted by photographing.

2. In order to find the moment of inertia, a basket suspended with a wire having a length of 120 cm in which a ball was entered, was turned 8 times, and the rotational cycle was measured after detaching a hand from the basket. The rotational cycle was measured 3 times and the average was taken. The moment of inertia was found according to the following equations.

$T_L$: Rotational cycle of big steel ball $T_S$: Rotational cycle of small steel ball $I_L$: Moment of inertia of big steel ball (487.2021 g.cm$^2$)

$I_S$: Moment of inertial of small steel ball (326.5804 g.cm$^2$)

l: Length of the wire (120 cm)

r: Diameter of the wire (0.15 mm)

T: Rotational cycle of ball (sec.)

Moment of inertia of the basket $$I_0 = \frac{I_S T_L^2 - I_L T_S^2}{T_S^2 - T_L^2}$$

Modulus of rigidity of the wire $$h = \frac{8l\pi(I_S - I_L)}{r^2(T_S^2 - T_L^2)}$$

Moment of inertia of the ball $$I_b = \frac{hr^4}{8l\pi} \cdot T^2 - I_0$$

As shown in Table 1, the spinning frequency of the ball of Example 1 whose core has a high specific gravity is larger than that of the ball of Comparative Example 2 which corresponds to a conventional two-piece ball. Therefore, the ballistic trajectory is close to that of the wound ball of Comparative Example 5 and the flight distance is long. In contrast, in case of the ball of Comparative Example 1 which has a three-layer construction as the ball of Example 1, the spinning frequency is lower because of the low specific gravity of the core and, therefore, the ballistic trajectory is low and the flight distance is short. Also, the spinning frequency of the ball of Comparative Example 3 does not reach a desired value because of the high hardness of the cover, and consequently, the ballistic trajectory is low and the flight distance is short. The properties of the ball of Comparative Example 4 were not measured, because the ball cannot come up to PGA Standards in weight because of the excessive size of the core.

As mentioned above, the golf ball of the present invention can get the same level of flight distance and controllability as wound balls, keeping an excellent cut resistance which is a feature of solid golf balls.

In addition to the ingredients used in the Example, other ingredients can be used in the Example as set forth in the specification to obtain substantially the same results.

What we claim is:

1. A solid golf ball consisting of a core, an intermediate layer and a cover, said core having a diameter of not more than 32 mm and a specific gravity of not less than 1.50 and being a composition comprising 100 parts by weight of a polybutadiene rubber, 10 to 50 parts by weight of zinc acrylate or methacrylate, 10 to 150 parts by weight of zinc oxide and 1 to 5 parts by weight of a crosslinking or curing agent; said intermediate layer having a thickness of 3.2 to 5.4 mm and being a composition comprising 100 parts by weight of a polybutadiene rubber, 10 to 50 parts by weight of zinc acrylate or methacrylate, 0 to 30 parts by weight of zinc oxide and 1 to 5 parts by weight of a crosslinking or curing agent, the specific gravity of said intermediate layer being lower than that of said core; and said cover having a thickness of 1 to 3 mm and a Shore D hardness of not more than 64.

2. The solid golf ball of claim 1, wherein the crosslinking or curing agent is a peroxide.

3. The solid golf ball of claim 2, wherein the peroxide is dicumyl peroxide.

4. The solid golf ball of claim 1, wherein the cover comprises an ionomer resin.

* * * * *